US008851434B2

(12) United States Patent
Menning et al.

(10) Patent No.: US 8,851,434 B2
(45) Date of Patent: Oct. 7, 2014

(54) CLEAT-MOUNTABLE ACCESSORY APPARATUS

(75) Inventors: John Menning, Gretna, NE (US); Jeree Menning, Gretna, NE (US)

(73) Assignee: LC Watersports, Inc., Gretna, NE (US)

( * ) Notice: Subject to any disclaimer, the term of this patent is extended or adjusted under 35 U.S.C. 154(b) by 1119 days.

(21) Appl. No.: 11/982,744

(22) Filed: Nov. 5, 2007

(65) Prior Publication Data

US 2008/0105800 A1 May 8, 2008

Related U.S. Application Data

(60) Provisional application No. 60/856,503, filed on Nov. 3, 2006.

(51) Int. Cl.

| | |
|---|---|
| ***A47B 96/06*** | (2006.01) |
| ***B63B 35/79*** | (2006.01) |
| ***B63B 23/62*** | (2006.01) |
| ***B63B 29/06*** | (2006.01) |

(52) U.S. Cl.

CPC ..... *B63B 29/06* (2013.01); *B63B 35/7946* (2013.01); *B63B 23/62* (2013.01)

USPC ..... 248/206.3; 248/220.41

(58) Field of Classification Search

USPC ..... 248/205.5, 206.1, 206.2, 206.3, 220.21, 248/220.22, 222.51, 299.1, 220.41, 316.2; 211/113, 115, 116, 117

See application file for complete search history.

(56) References Cited

U.S. PATENT DOCUMENTS

| | | | | |
|---|---|---|---|---|
| 4,696,447 | A * | 9/1987 | Strecker | 248/206.3 |
| 5,664,752 | A * | 9/1997 | Matthiessen et al. | 248/299.1 |
| 5,791,625 | A * | 8/1998 | Orser | 248/495 |
| 6,435,462 | B2 * | 8/2002 | Hawes | 248/299.1 |
| 6,709,184 | B1 * | 3/2004 | McDonald | 403/98 |
| 6,779,765 | B2 * | 8/2004 | Zheng et al. | 248/206.3 |
| 6,918,495 | B1 * | 7/2005 | Hoy | 211/66 |
| 7,658,354 | B2 * | 2/2010 | Wang | 248/205.5 |
| 2006/0131467 | A1 * | 6/2006 | Wang | 248/276.1 |

* cited by examiner

*Primary Examiner* — Steven Marsh

(74) *Attorney, Agent, or Firm* — Suiter Swantz pc llo

(57) ABSTRACT

The present invention is directed to an apparatus and a method for coupling an apparatus to a cleat.

A cleat-mounted support apparatus in accordance with the present invention may comprise: (a) a first bracket portion; (b) a second bracket portion; and (c) bracket coupling means.

A cleat-mountable apparatus in accordance with the present invention may comprise: (a) a cleat-mountable support; (b) an accessory.

A method for coupling a cleat-mounted apparatus to a cleat in accordance with the present invention may comprise one or more of the steps: (a) disposing a first bracket portion about a cleat member; (b) disposing a second bracket portion about the cleat member; and (c) operatively coupling the first and second bracket portions.

18 Claims, 10 Drawing Sheets

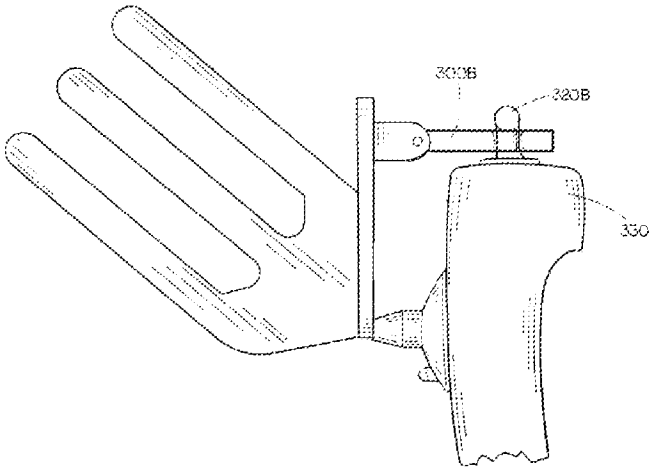
FIG. 3C
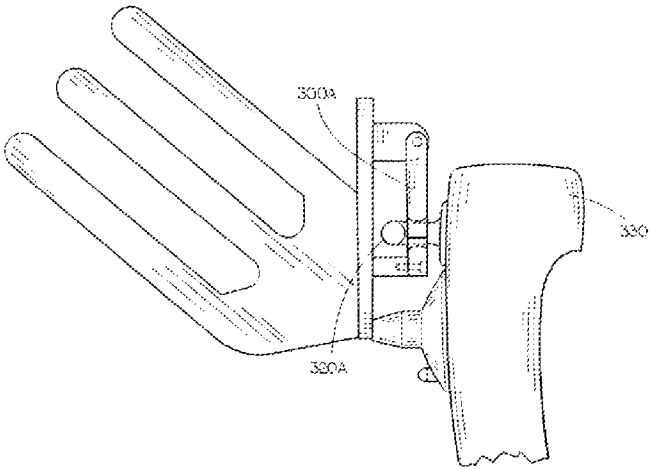

CLEAT-MOUNTABLE ACCESSORY APPARATUS

CROSS-REFERENCE TO RELATED APPLICATION

The present application claims the benefit of U.S. Provisional Application Ser. No. 60/856,503, filed Nov. 3, 2006. The present application herein incorporates U.S. Provisional Application Ser. No. 60/856,503 by reference in its entirety.

BACKGROUND

Considerable design efforts have been applied to the development of boating accessories and their spatial arrangement around the passenger compartments of recreational watercraft. In order to maximize the enjoyment of time spent on the water, it is preferable that boating accessories are located such that they refrain from hindering the movement of occupants while still performing the functions for which they are intended. Currently, there are various means of mounting equipment racks, lamps, audio speakers, and other accessories to a boat.

In some cases, accessory supports will have to be screwed or bolted to the boat hull. To screw or a bolt a device to a boat, holes must be drilled into the hull thereby damaging or weakening the boat and further accelerating corrosion or deterioration. Alternately, accessory supports may be affixed to a boat via a grooved bracket fastened to a boat railing. As such railings are commonly tubular in shape, use of a rounded bracket in combination with a rounded bracket results in a support with reduced stability which may not be equipped to handle the mounting of heavy accessories.

Many of today's outdoor enthusiasts enjoy spending time participating in recreational boating activities including waterskiing, wakeboarding, wake skating, and other popular watersports. Such activities entail the use of watersports equipment with extended dimensions requiring efficient mechanisms for their storage or restraint on a boat. However, many of the products currently available for efficiently storing watersports equipment are constructed such that they are only mountable to vertical tow pylons or tow towers. Watercrafts which do not incorporate such structures are unable to take advantage of the space saving features of these storage apparatus.

However, a vast majority of today's recreational watercraft are equipped with cleats located around their periphery. These cleats serve to provide tie-down locations for anchoring or mooring a craft in a given location. When a cleat is placed on the boat by a manufacturer, the area where the cleat is mounted may be reinforced to withstand greater forces such as towing or docking a boat with the cleat. As these reinforced cleats are generally disposed outside of the main passenger compartments, they may serve as a preferable location for affixing boating accessories.

Therefore, it would be desirable to provide a cleat-mountable support which may be secured to a cleat. Further, it would be desirable to provide an equipment rack operably connected to a cleat-mountable support.

SUMMARY OF THE INVENTION

A cleat-mountable support may comprise: (a) a first bracket portion; (b) a second bracket portion; and (c) bracket coupling means.

A cleat-mountable apparatus may comprise: (a) a cleat-mountable support; (b) an accessory.

A method for coupling a cleat-mounted apparatus to a cleat may comprise one or more of the steps: (a) disposing a first bracket portion about a cleat member; (b) disposing a second bracket portion about the cleat member; and (c) operatively coupling the first and second bracket portions.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which:

FIG. 3C depicts operational modes of a cleat-mountable support apparatus in accordance with embodiments of the invention;

DETAILED DESCRIPTION OF THE INVENTION

Reference will now be made, in detail, to presently preferred embodiments of the invention. Additional details of the invention are provided in the examples illustrated in the accompanying drawings.

Figure 1:
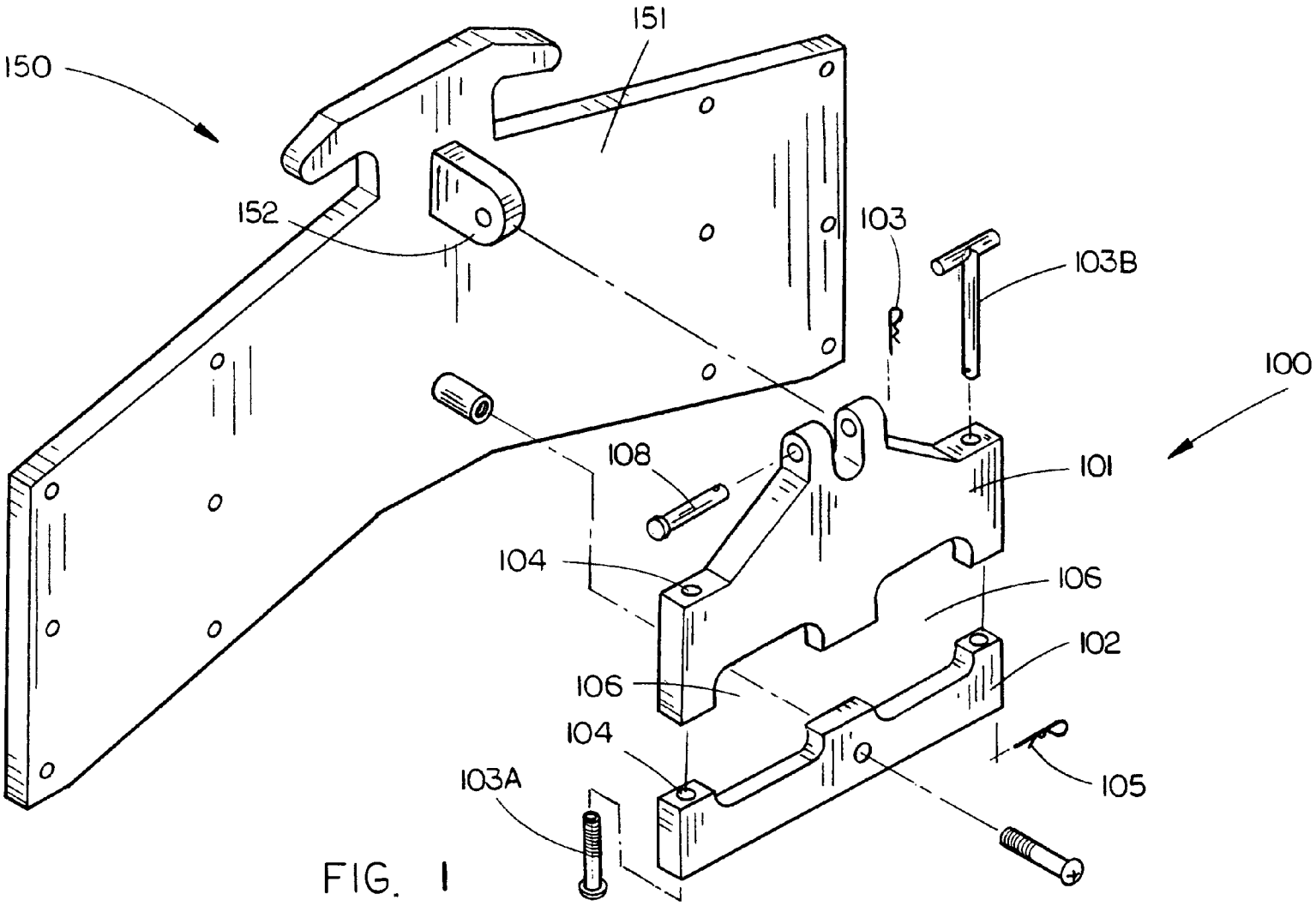
FIG. 1 depicts a cleat-mountable support apparatus in accordance with an embodiment of the invention.

Referring to FIG. 1, a cleat-mountable support 100 in accordance with an embodiment of the present invention is depicted. The cleat-mountable support may comprise a first bracket portion 101 and a second bracket portion 102. The first bracket portion 101 and second bracket portion 102 may be constructed from sturdy, lightweight, corrosion resistant materials common in the art such as aluminum, fiberglass, carbon-fiber composites, various plastics, and the like.

The first bracket portion 101 and the second bracket portion 102 may be operably coupled by inserting a bolt 103A or locking pin 103B through apertures 104 in the both bracket portions 101, 102. One or both of the apertures 104 may be threaded so as to cooperatively engage mutually threaded portions of a bolt 103A. Alternately, locking pin 103B may be further secured by a cotter pin 105. In further embodiments, the first bracket portion 101 and the second bracket portion 102 may be operably coupled via mechanisms common in the art including clips, clamps, straps and hooks, among others.

When the bracket portions 101, 102 are coupled, the adjoining surfaces of the first bracket portion and the second bracket portion are configured such that they form one or more apertures 104 so that the support may be disposed around projecting members of a cleat.

The support apparatus described above may be used in combination with any number of boating accessories such as equipment racks, audio speaker assemblies, tow-rope winders/racks, lamps, fishing rod holders, grills, beverage cup holders, trolling motors, bimini-type covers, or any other accessory for which it may be desirable to attach to a cleat. The cleat-mountable support may further comprise a clevis-type connector 107 for coupling the support 100 to an accessory. In a particular embodiment, the accessory may comprise an equipment rack 150 having a base member 151.

In a particular embodiment of the invention, the clevis-type connector 107 may receive a cooperating clevis projection 152 disposed on the base member 151. A clevis pin 108 may be utilized to link the clevis-type connector 107 and the cooperating clevis projection 152. The clevis-type connector 107 and the cooperating clevis projection 152 may be configured such that the lengthwise axis of the clevis pin 108 is substantially parallel to the horizontal plane of the cleat. Such an arrangement allows upward rotational movement of an equipment rack 150 so as to provide for easy access to equipment placed in lower receiving slots. The clevis pin 108 may also be removable so that the equipment rack 150 may be rapidly separated from the cleat-mounted support 100. In a further embodiment, the clevis pin 108 may be held in place by a cotter pin 109.

Figure 2:
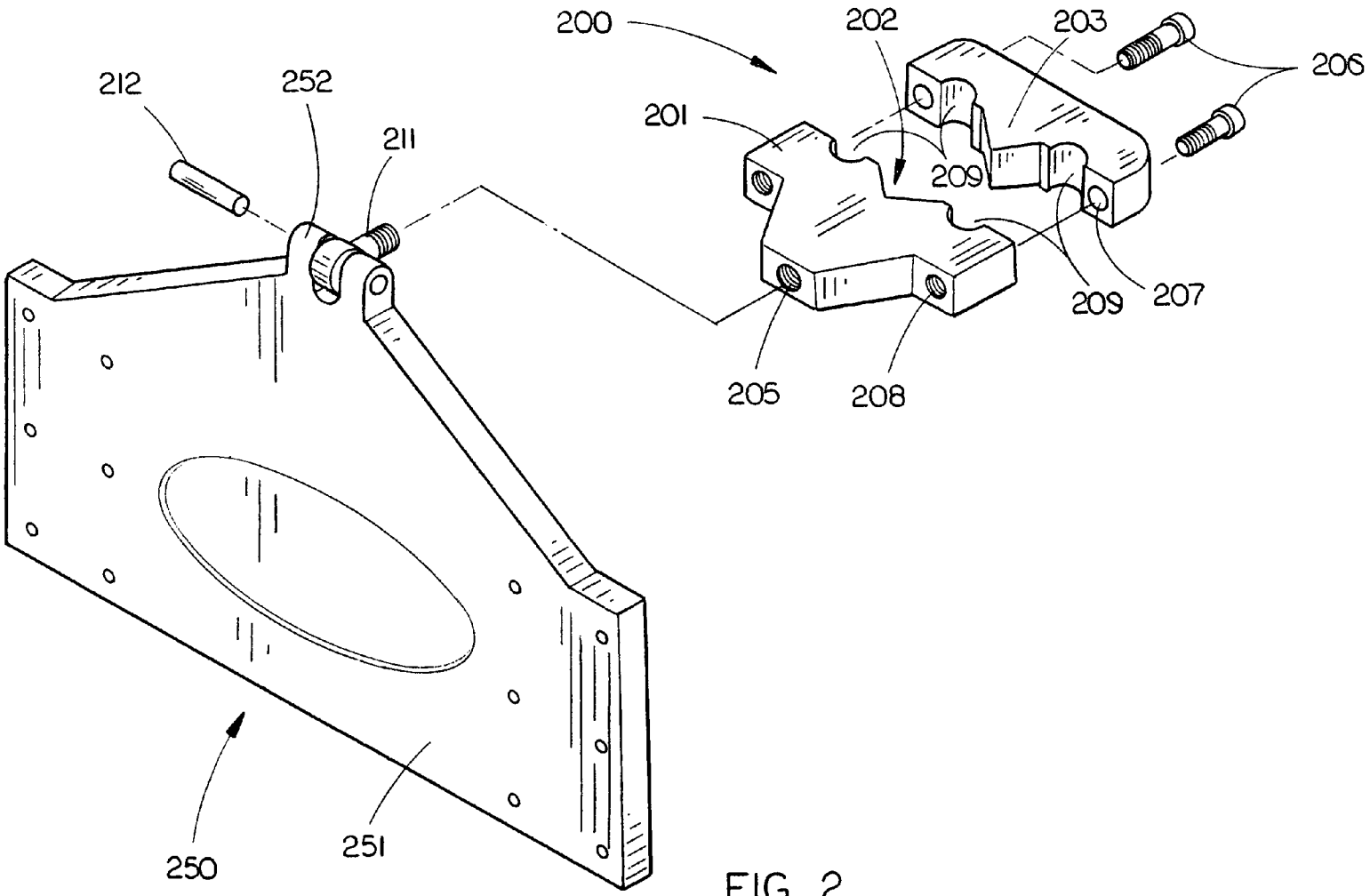
FIG. 2 depicts a cleat-mountable support apparatus in accordance with an embodiment of the invention.

Referring to FIG. 2, a cleat-mountable support 200 in accordance with an embodiment of the present invention is depicted. The adjoining surfaces of a first bracket portion 201 and a second bracket portion 202 may be configured such that a ridge 203 disposed in the surface of the second bracket portion 102 may cooperatively engage a void 204 disposed in the surface of the second bracket portion 202. Such an arrangement may provide additional lateral support complementing the coupling force provided by bolts or pins 206 coupling the first bracket portion and the second bracket portion. Bolts 206 may be inserted through apertures 207 in the second bracket portion 202 where they may be received by threaded apertures 208 in the first bracket portion 201. When the bracket portions 201, 202 are coupled, the adjoining surfaces of the first bracket portion 201 and the second bracket portion 202 are configured such that they form one or more apertures 209 which may be disposed around the projecting members of a cleat.

The first bracket portion 201 of the support 200 may include an aperture 205 into which a clevis projection 211 may be inserted. The bracket aperture 205 and the clevis projection 211 may be operably coupled by mutual threading, chemical adhesion, soldering or other mechanism common in the art. An equipment rack 250 may comprise a base member 251 having a clevis connector 252 into which the clevis projection 211 may be inserted. A clevis pin 212 may be utilized to link the clevis connector 252 and the clevis projection 211.

Figure 3A:
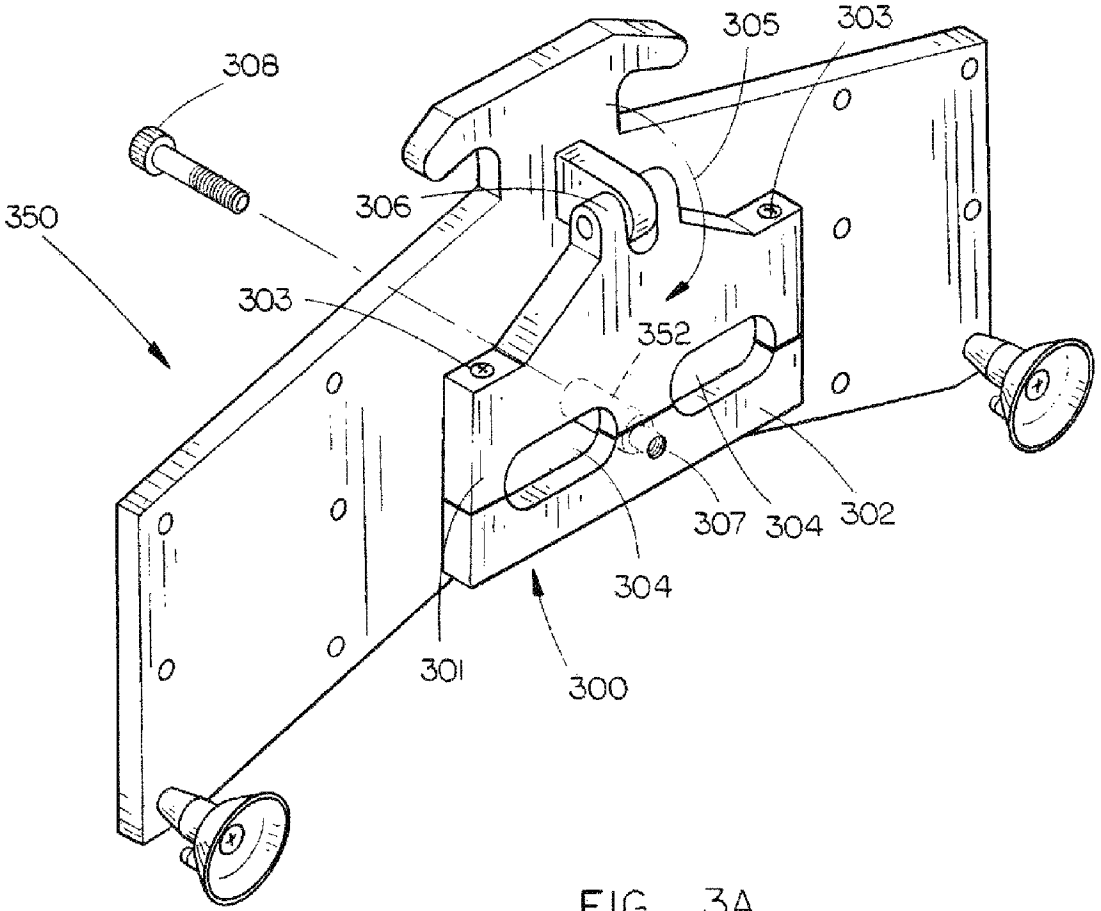
FIG. 3A depicts an operational mode of a cleat-mountable support apparatus in accordance with an embodiment of the invention.

Referring to FIGS. 3A through 4B, various operational modes of a cleat-mountable support 300/400 in combination with an equipment rack 350 are presented. Referring to FIG. 3A, a cleat-mountable support 300 is operably coupled to a cleat 320. In particular embodiments, a cleat 320/421 may be affixed to a support surface in a horizontally or vertically projecting fashion.

Figure 4A:
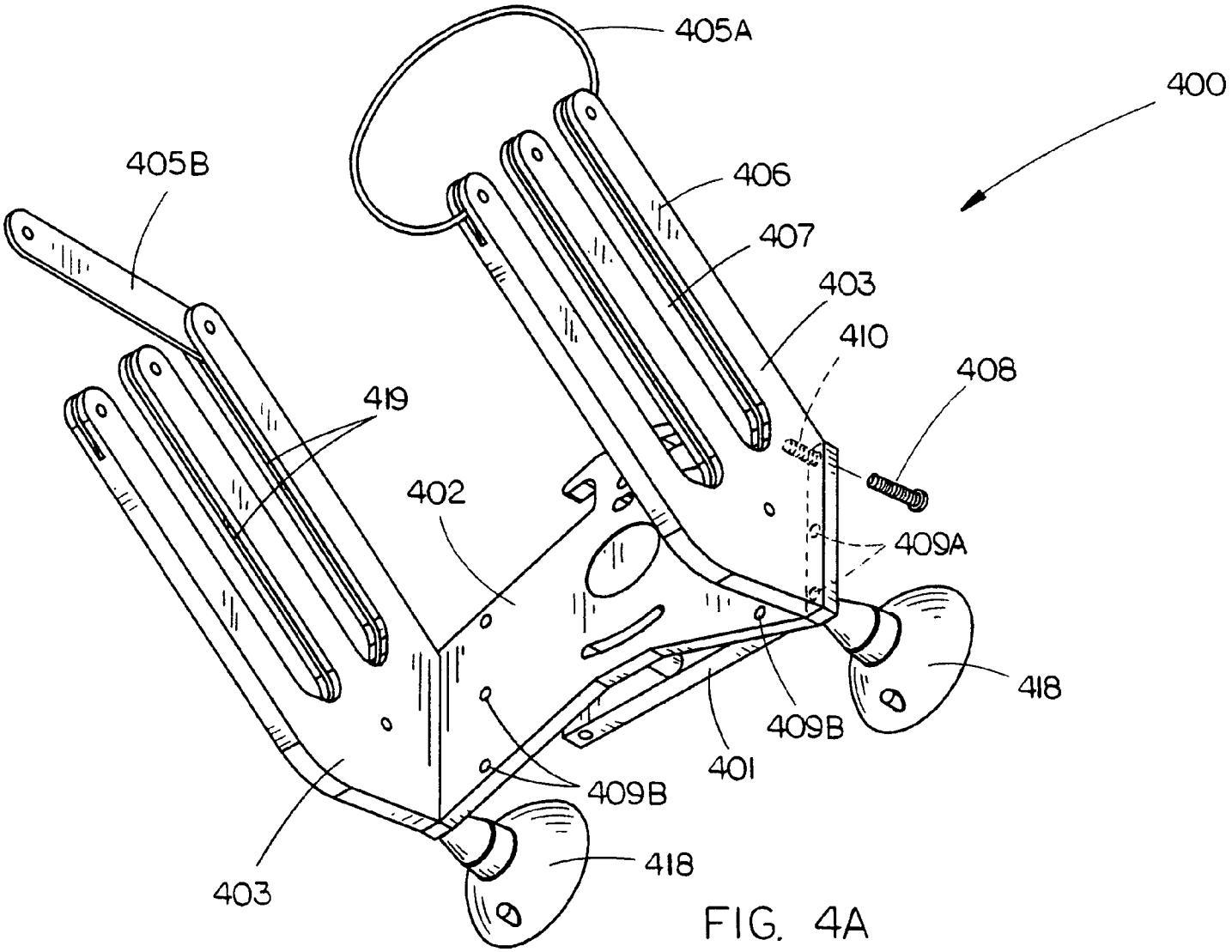
FIG. 4A depicts an a cleat-mountable equipment rack in accordance with an embodiment of the invention.
Figure 4B:
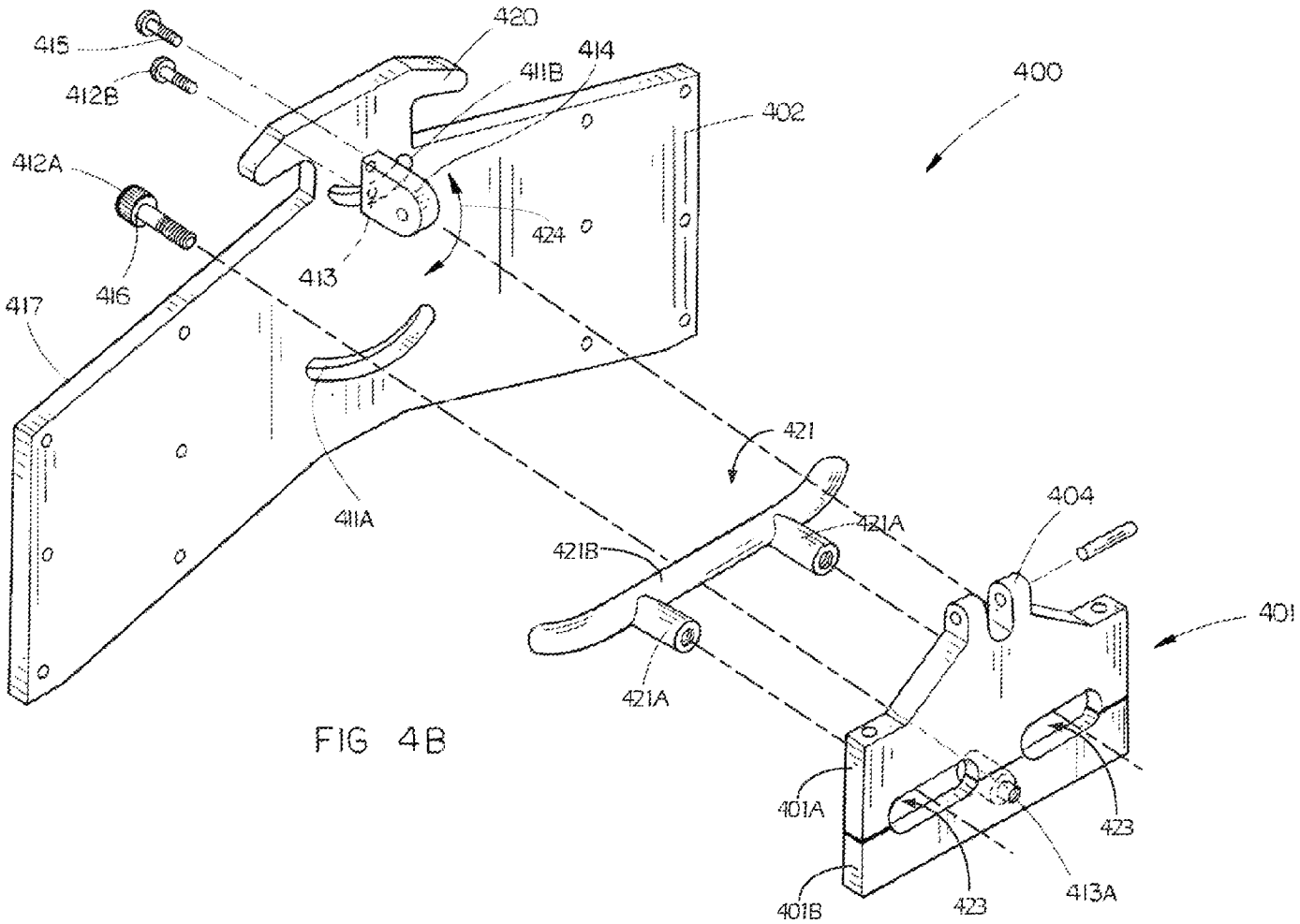
FIG. 4B depicts an a cleat-mountable equipment rack in accordance with an embodiment of the invention.

Referring to FIG. 4B, a first bracket portion 401A and a second bracket portion 401B may be operably coupled by bolts and cooperating apertures as previously presented. The coupled bracket portions 401A and 401B are configured such that they form one or more apertures 423 disposed around the horizontally projecting members 421A of a cleat 421. The support 400 may be rotated 424 about a clevis connector 414 so as to shift the plane of the support 400.

In a further embodiment of the invention, referring to FIG. 3A, the support 300 and a base member 351 of the equipment rack 350 may comprise apertures 307, 352 which are collinearly aligned when the support 300 is rotated into the substantially vertical orientation. A connection bolt or pin 308 may be inserted through the base member aperture 352 and cooperatively engage the support aperture 307 so as to retain the equipment rack 350 in a substantially vertical orientation.

Figure 3B:
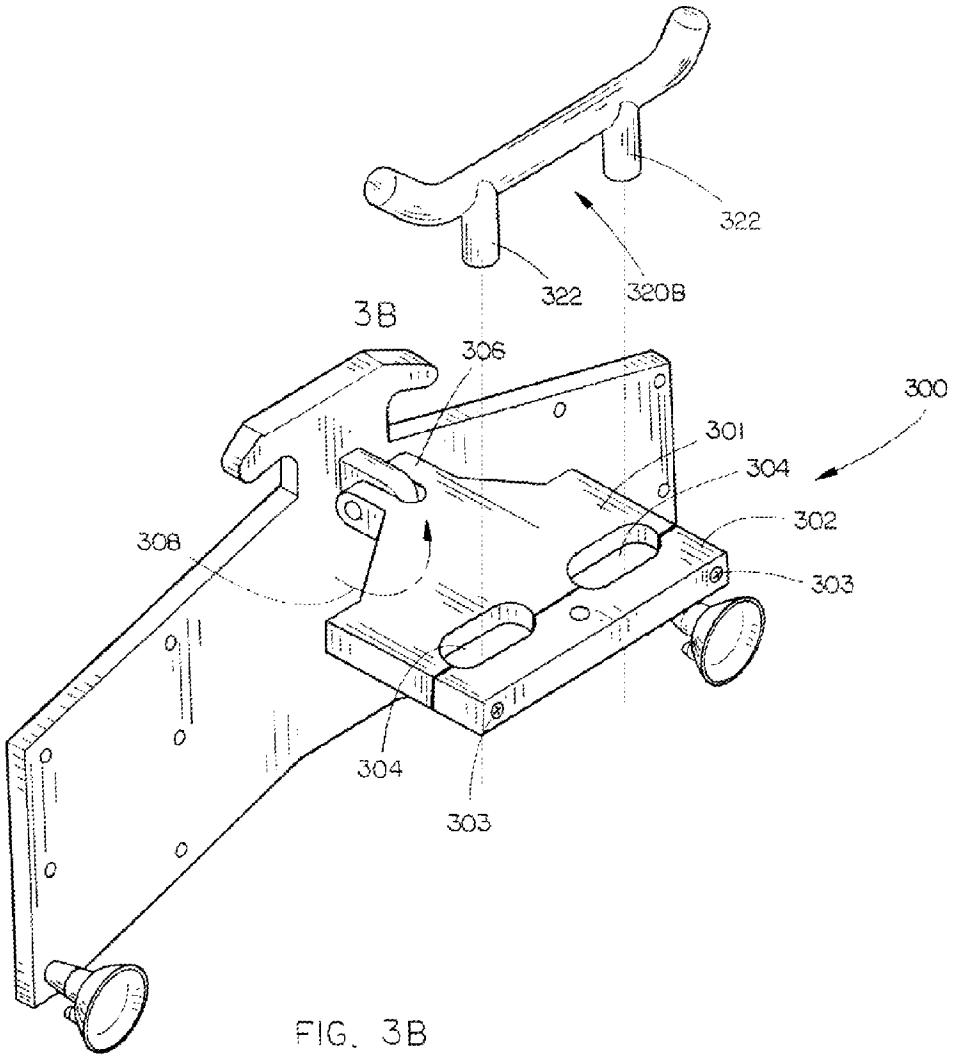
FIG. 3B depicts an operational mode of a cleat-mountable support apparatus in accordance with an embodiment of the invention.

Similarly, Referring to FIG. 3B, a cleat-mountable support 300 is operably coupled to a cleat 320. In a particular embodiment, a cleat 320 may be affixed to a support surface in a vertically projecting fashion. The first bracket portion 301 and the second bracket portion 302 may be operably coupled by bolts or pins 303 disposed within cooperating apertures as previously presented. The coupled bracket portions 301, 302 are configured such that they form one or more apertures 304 disposed around the vertically projecting members 322 of a cleat. The support 300 may be rotated 305 about a clevis connector 306 so as to shift the plane of the support 300 into a substantially horizontal orientation.

Referring to FIG. 3C, the vertical 300A and horizontal 300B configurations are shown in reference to horizontally configured cleat 320A and vertically configured cleat 320B, respectively. Each cleat 320 may be affixed to a boat hull 330 or any other support surface having an attached cleat, such as a pickup truck bed, an automobile roof rack, a wall-mounted storage rack, and the like.

Figure 3D:
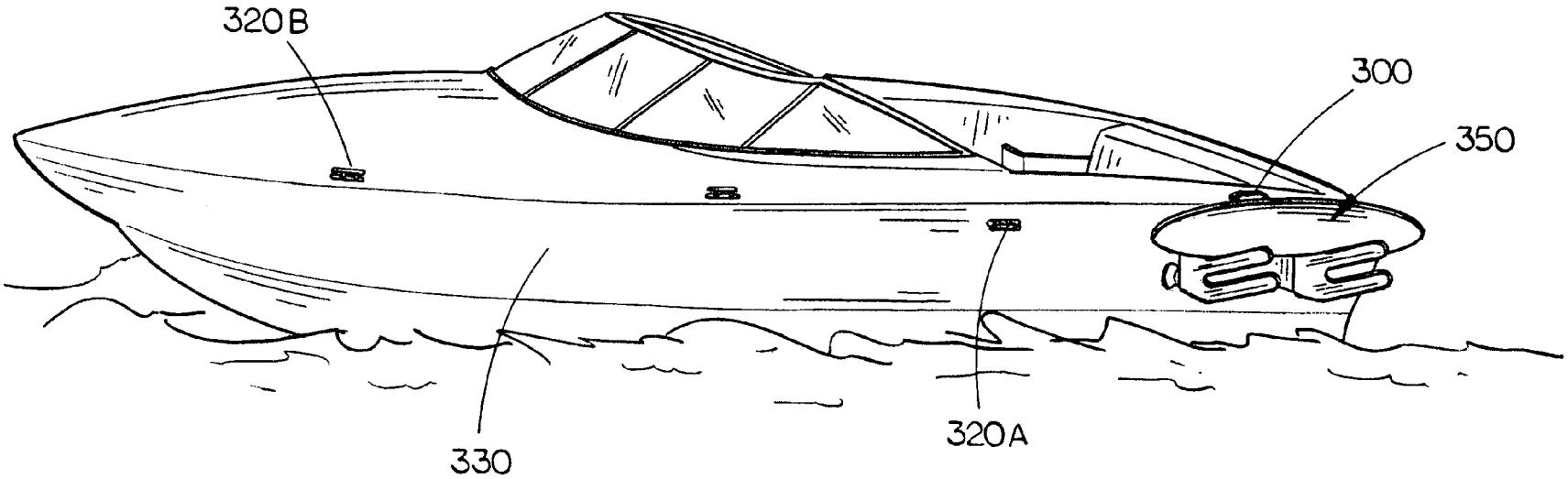
FIG. 3D depicts a cleat-mountable equipment rack attached to a boat accordance with embodiments of the invention.

Referring to FIG. 3D, an equipment rack incorporating the cleat-mounted support 300 of the present invention is shown attached to a boat. As previously presented, the cleat-mounted support may be coupled to cleats configured so as to project either horizontally 320A or vertically 320B from a support surface 330, such a boat hull.

Figure 4C:
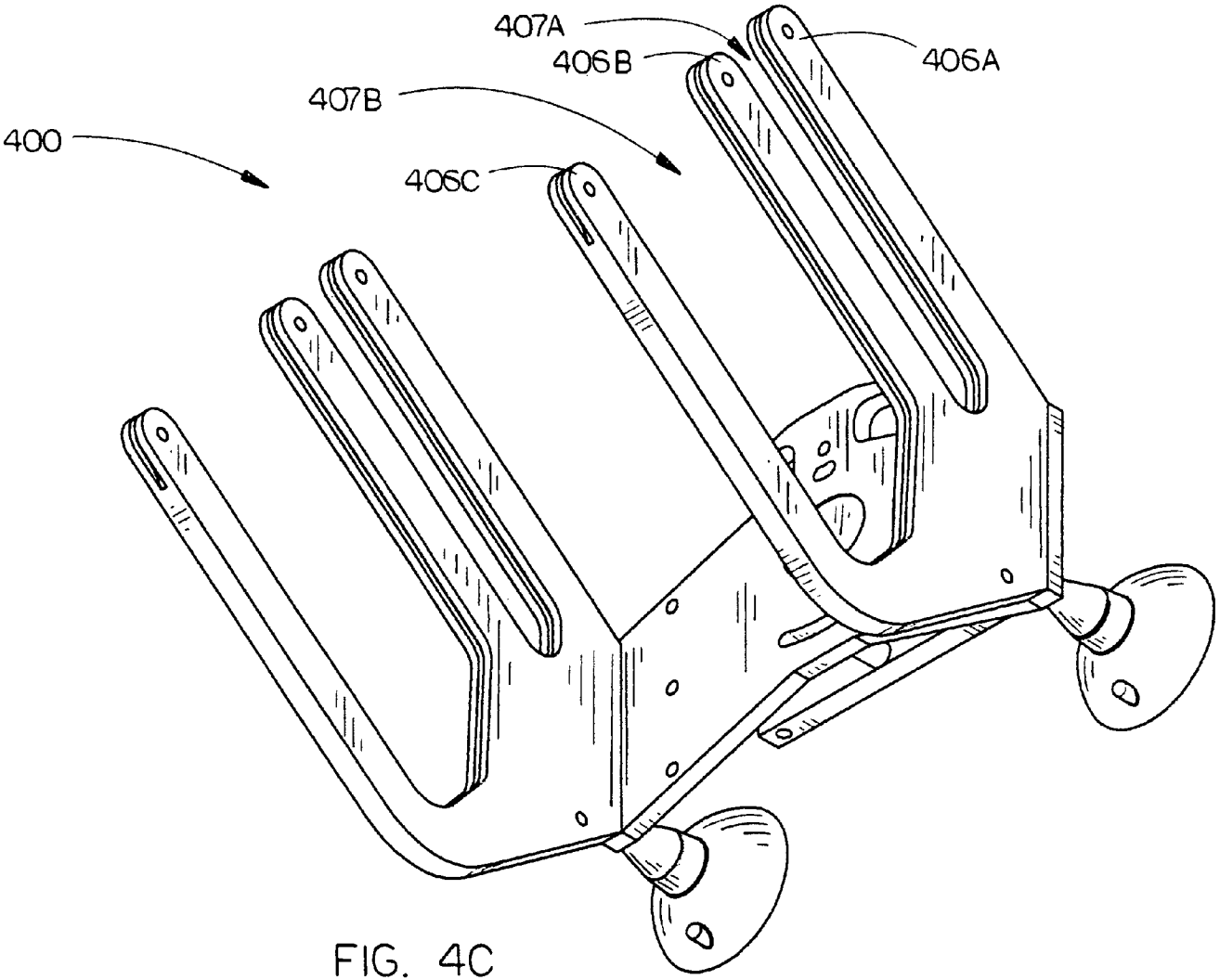
FIG. 4C depicts an a cleat-mountable equipment rack in accordance with an embodiment of the invention.

Referring to FIGS. 4A-4C, a cleat-mountable equipment rack 400 in accordance with an embodiment of the present invention is depicted. The equipment rack may comprise a cleat-mountable support 401, a rack base member 403, and a clevis connector 404, such as those previously presented with respect to FIGS. 1-3D. For example, a cleat-mountable support 401 may be operably coupled to a cleat 421. In a particular embodiment, as shown in FIG. 4B, the cleat 421 may be affixed to a support surface (e.g. a boat hull) in an at least partially horizontally projecting fashion. A first bracket portion 401A and the second bracket portion 401B of the cleat-mountable support 401 may be operably coupled by bolts or pins (not shown) disposed within cooperating apertures 422 as previously presented. The coupled bracket portions 401A and 402B may be configured such that they form one or more apertures 423 disposed at least partially around the horizontally projecting members 421A of the cleat 421 allowing the cleat-mountable support 401 to be secured between a cross-member portion 421B of the cleat 421.

Further, the equipment rack may comprise one or more equipment receivers 403 and associated locking mechanisms 405. The cleat-mountable support 401, base member 402, equipment receivers 403 and clevis connector 404 may be constructed from sturdy, lightweight, corrosion resistant materials common in the art such as aluminum, fiberglass, carbon-fiber composites, various plastics, and the like.

The equipment receivers 403 may comprise any number of mechanisms common in the art including straps, clamps, and support arms. In the depicted embodiment, the equipment receivers 403 comprise three support arms 406 defining two equipment slots 407. The arms 406 may angle upward so that equipment to be stored may be placed in the slots 407 and may rest in the slots by their own weight and so that the extent to which the rack 400 protrudes from a cleat-containing surface is reduced. The equipment receivers 403 may be operably coupled to the base member 402 by inserting bolts 408 through apertures 409 in the base member 402 where they may be received by threaded apertures 410 in the equipment receivers. The base member may further comprise multiple sets of apertures 409A, 409B so that relative separation of the equipment receivers 403 may be adjusted to accommodate various sized pieces of equipment.

The equipment rack 400 may further comprise a locking mechanism 405 for securing various pieces of equipment within the equipment receivers 403. Such locking mechanisms may include elastic bungee cords 405A, hinged locking members 405B, nylon straps (not shown), or other mechanisms common in the art.

Referring to FIG. 4B, in a further embodiment of the invention, the rack 400 may comprise one or more arcuate apertures 411 disposed within the base member 402. One or more locking bolts 412A may be operable coupled to the support 401 by inserting the bolts 412A through the apertures 411A where they may be received by threaded apertures 413A. Similarly, one or more locking bolts 412B may be operably coupled to a rotatable clevis projection 414. The clevis projection 414 may be coupled to the base member 402 by a bolt 415 such that the clevis projection remains rotatable about an axis defined by the bolt 415.

Such configurations permit the locking bolts 412 to travel along the arcuate apertures 411 to allow the base member 402 to be aligned in a substantially horizontal position, regardless of the mounting position of the support 401. Once the base member has been placed in a desired rotational position, the locking bolts 412 may be tightened so as to engage the undersurface 416 of the locking bolts 412 with an outer surface 417 of the base member so as to affix the base member in the desired rotational position with respect to the support 401.

It should be noted that, through the use of multiple locking bolts 412, the base member 402 may be affixed in a desired position when the support 401 is configured in a substantially vertical position (as shown in FIG. 4B) using locking bolts 412A and 412B or in a substantially horizontal position (not shown) using only locking bolt 412B.

In still a further embodiment of the invention, the base member 402 may comprise a cleat-type projection 420. As the equipment rack 400 is adapted to utilize a cleat member for securing the rack 400 to a given surface, that particular cleat is no longer available for other uses, such as securing a rope. The incorporation of the cleat-type projection 420 restores this functionality. The cleat-type projection 420 may comprise any type of cleat shapes common to the art.

Referring again to FIG. 4A, the equipment rack 400 may also comprise one or more suction cups 418 disposed on an inner surface of the base member 402. The suction cups 418 may serve to provide enhanced stability by allowing for a portion of the weight of the equipment rack to be diverted from the cleat-mounted support 401 to the cleat-containing surface. Additionally, the suction cups may prevent the surface of the equipment rack from contacting the cleat-containing surface by providing a non-abrasive anchoring mechanism, thereby avoiding any possible damage due to the movement of the rack. In further embodiments, where additional stability is not required the suction cups 418 may be replace by simple non-abrasive bumper elements such as rubber knobs or projections.

As a piece of equipment is inserted into the equipment receivers 403 for storage, it will necessarily contact the surfaces of the equipment receivers 403. In order to minimize damage to the surfaces of the equipment rack 400 or the equipment, the interior surfaces of the equipment receivers may be covered with a layer of cushioning material 419, such as rubber, or any other material suitable for damping impact shock.

Referring to FIG. 4C, the dimensions of the support arms 406 and their spatial relationship may be defined so as to provide secure storage for various sized equipment items. For example, a first support arm 406A and second support 406B arm may be configured such that they will present a first slot 407A capable of receiving a smaller piece of equipment, such as pair of water skis. Additionally, the second support arm 406B and a third support arm 406C may be configured such that they will present a second slot 407B capable of receiving a larger piece of equipment, such as knee board. It is fully contemplated that an equipment rack in accordance with the present invention may comprise any number of equipment receiving slots. The slot dimensions may be configured such that the rack may accommodate one or more types of equipment, such as water skis, wake boards, knee boards, wake skates, or any combination thereof. In a further embodiment of the invention, the support arms 406 may be adjustable so as to present variable-sized receiving slots 407 to be configured by a user so as to adapt to the storage needs for varying combinations of equipment.

Figure 5:
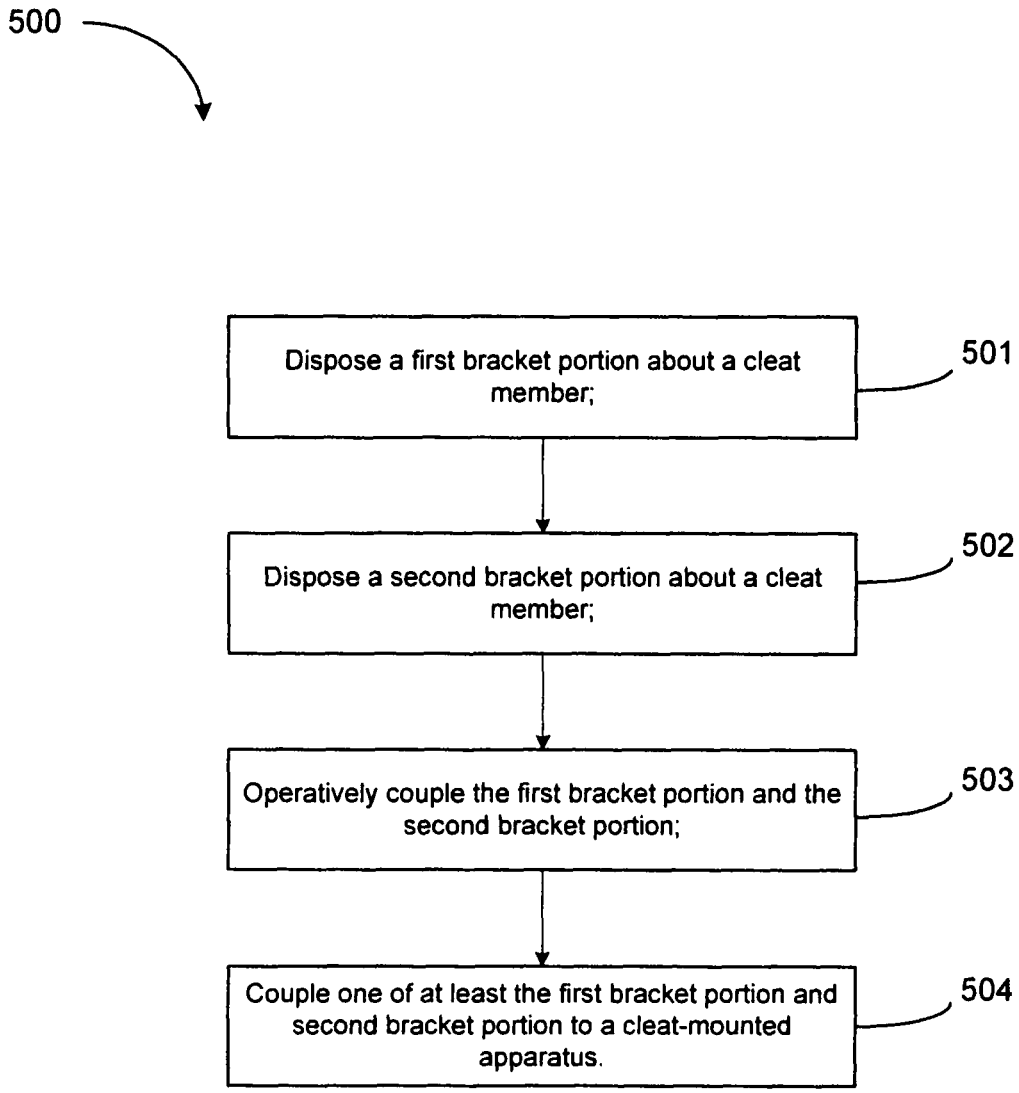
FIG. 5 depicts an a process flow diagram for a method for attaching a cleat-mountable apparatus to a cleat.

Referring to FIG. 5, a process flow diagram is presented detailing a method 500 for attaching a cleat-mounted apparatus to a cleat. First and second bracket portions may be disposed about a cleat at steps 501 and 502. The bracket portions may be configured such that, in disposing them about the cleat, they cooperatively form one or more apertures substantially surrounding a portion of the cleat.

In order to secure the first and second bracket portions about the cleat, they may be operatively coupled at step 503. The step of coupling the first and second bracket portions may comprise providing bolts or pins to collinearly aligned apertures of the first and second bracket portions which cooperatively engage threaded portions of the apertures.

In further embodiments the combined bracket portions are coupled to an accessory apparatus which is to be mounted to a cleat. The cleat-mounted accessory apparatus may be selected from the group comprising: an equipment rack; an audio speaker assembly; a tow-rope winder/rack, or a lamp. The cleat-mounted apparatus may be coupled to at least one of the first bracket portion or the second bracket portion at step 504.

In a particular embodiment where the cleat-mounted apparatus is an equipment rack, one of at least the first bracket portion or the second bracket portion may be coupled to a base member of the rack. An equipment receiver may be coupled to the base member. In order to secure a piece of equipment, the equipment may be disposed in the equipment receiver.

It is believed that the present invention and many of its attendant advantages will be understood from the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A support system comprising:

a cleat including:

a projection portion projecting from a support surface, and a cross-member portion operably coupled to the projection portion at an angle;

a first bracket;

a second bracket; and bracket coupling means configured to operably couple the first bracket and the second bracket to cooperatively at least partially encircle the projection portion of the cleat.

2. The support system of claim 1, further comprising:

a clevis connector.

3. The support system of claim 1, wherein the bracket coupling means is selected from at least one of:

a bolt; a pin; a clip; a clamp; a strap and a hook.

4. The support system of claim 1, further comprising:

an accessory operably coupled to at least one of the first bracket and the second bracket.

5. The support system of claim 4, further comprising:

a clevis connector;

a clevis projection; and a clevis pin, wherein the clevis connector, clevis projection and clevis pin operably couple the cleat-mounted support and the accessory.

6. The support system of claim 4, wherein the accessory is selected from at least one of:

an equipment rack; an audio speaker assembly; a tow-rope winder, a tow-rope rack, and a lamp.

7. The support system of claim 4, wherein the accessory is an equipment rack, the equipment rack comprising:

a base plate; and an equipment receiver.

8. The support system of claim 7, wherein the base plate comprises:

an arcuate aperture.

9. The support system of claim 8, further comprising:

a locking pin, wherein the locking pin is received by the arcuate aperture and a cooperating aperture disposed within at least one of the first bracket and the second bracket.

10. The support system of claim 7, wherein the base plate comprises:

a cleat including:

a projection portion projecting from the base plate, and a cross-member portion operably coupled to the projection portion at a an angle.

11. The support system of claim 7, wherein the equipment receiver is selected from at least one of:

a support arm; a strap; and a clamp.

12. The support system of claim 11, the support arms further comprising:

a cushioning layer.

13. The support system of claim 7, further comprising:

an equipment locking mechanism.

14. The support system of claim 13, wherein the equipment locking mechanism is selected from at least one of:

an elastic cord, a hinged locking member, and a nylon strap.

15. A method for attaching a cleat-mounted apparatus to a cleat, the method comprising the steps:

disposing a first bracket and a second bracket about a portion of a cleat projecting from a support surface and oriented at a angle relative to a cross-member of the cleat such that the first bracket and the second bracket cooperatively at least partially encircles the portion of the cleat projecting from a support surface; and operatively coupling the first and second brackets.

16. The method of claim 15, further comprising the step:

coupling an accessory to at least one of the first bracket or the second bracket.

17. The method of claim 16, wherein coupling an accessory to at least one of the first bracket or the second bracket further comprises:

coupling a base member of an equipment rack to the at least one of the first bracket or the second bracket.

18. The method of claim 17, further comprising the step:

coupling an equipment receiver to the base member.

* * * * *